US005979321A

United States Patent [19]

Koppelkamm et al.

[11] Patent Number: 5,979,321

[45] **Date of Patent: *Nov. 9, 1999**

[54] CASSETTE FOR A WEDGE-SHAPED INK WELL OF PRINTING MACHINES

[75] Inventors: Günter Koppelkamm, Neuensalz; Bernd Hennig, Plauen-Oberlosa; Dieter Wagner, Neundorf, all of Germany

[73] Assignee: MAN Roland Drunkmaschinen AG, Offenbach am Main, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,090

[22] Filed: Oct. 2, 1997

[30] Foreign Application Priority Data

Oct. 2, 1996 [DE] Germany ..... 196 40 776

[51] Int. Cl.[6] ..... B41F 31/06; B41F 31/20

[52] U.S. Cl. ..... 101/363

[58] Field of Search ..... 101/207–210, 101/350.1, 350.6, 363, 366, 364, 365, 148

[56] References Cited

U.S. PATENT DOCUMENTS

| | | | |
|---|---|---|---|
| 1,893,148 | 1/1933 | Page . | |
| 4,700,631 | 10/1987 | Jurinak . | |
| 5,161,462 | 11/1992 | Okamura et al. | 101/207 |
| 5,327,830 | 7/1994 | Gelinas et al. | 101/363 |
| 5,461,979 | 10/1995 | Bruni . | |
| 5,481,974 | 1/1996 | Sarazen | 101/363 |

FOREIGN PATENT DOCUMENTS

| | | |
|---|---|---|
| 0 508 031 | 1/1992 | European Pat. Off. . |
| 575 775 | 12/1993 | European Pat. Off. . |
| 594 536 | 4/1994 | European Pat. Off. . |
| 69 12 105 | 3/1969 | Germany . |
| 23 65 738 | 4/1977 | Germany . |
| 39 14 647 | 11/1990 | Germany . |
| 91 13 480 | 2/1992 | Germany . |
| 43 15 595 | 2/1995 | Germany . |

OTHER PUBLICATIONS

German Search Report dated Apr. 3, 1997.

*Primary Examiner*—J. Reed Fisher

*Attorney, Agent, or Firm*—Cohen, Pontani, Lieberman & Pavane

[57] ABSTRACT

A cassette for a wedge-shaped ink well of a printing machine has a bottom and a rear wall and two side walls. A front of the cassette, opposite the rear wall, faces a duct roller of the printing machine when the cassette is inserted into the ink well and is open. A handle connected to the upper portions of the side walls is positioned such that the cassette tends to incline to prevent ink from flowing out of the front of the cassette when the cassette is handled outside of the printing machine. The bottom and the sides of the cassette are sealed against the ink well adjacent to the duct roller. A seating arrests movement of the cassette relative to the ink well when the cassette is inserted in the ink well thus ensuring that the duct roller uniformly inked between sides of the ink well.

14 Claims, 5 Drawing Sheets

CASSETTE FOR A WEDGE-SHAPED INK WELL OF PRINTING MACHINES

BACKGROUND OF THE INVENTION

1. Field of the Invention

The present invention relates to a cassette for insertion in a wedge-shaped ink well of a printing machine.

2. Description of the Related Art

A cassette for a wedge-shaped ink well is known from prior art reference DE 43 15 595 C2. The cassette in this prior art reference has two side walls connected by a bottom and a back wall. Attached to the bottom of the cassette are elastically deformable sealing elements. These elastically deformable sealing elements extend parallel to a duct roller and act against an elastically flexible ink blade in the wedge-shaped ink well. The cassette includes handle elements permitting the cassette to be handled outside of the wedge-shaped ink well. To prevent ink from flowing out of the cassette during its insertion into or removal from the wedge-shaped ink well (the position of which, including the duct roller, cannot be changed), the cassette includes a blocking gate which slides into blocking position along lateral guides in the open longitudinal side of the cassette. The blocking gate prevents ink from flowing out of the open longitudinal side.

The prior art reference includes a seal for the cassette on its front relative to the duct roller. However, the seal is complicated and prevents the duct roller from being inked in unlimited fashion over the full width of the ink well. An addition problem with this prior art device is that the three-point support for the cassette in the wedge-shaped ink well poses the risk of unstable positioning due to the hydrodynamic forces acting in the run-in space of the duct roller.

Another prior art reference, EP 0 508 031 A1, describes a cassette that can be suspended on the external gear of the ink duct by an angular piece and closed by a gate. To suspend the cassette, vertical clearance is needed relative to the duct roller. The elastically deformable ink blade in this reference disadvantageously provides additional support. This reference lacks sealing. Therefore, it is plausible that the ink will flow out of the cassette into the adjacent area of the wedge-shaped ink well. Also, a downwardly-directed handle attached to the back wall of the cassette of this reference makes the cassette difficult to handle, especially for wedge-shaped ink wells located below the operating plane.

SUMMARY OF THE INVENTION

It is an object of the present invention to provide a cassette for a wedge-shaped ink well of printing machines that ensures optimal inking of the duct roller between the side parts of the wedge-shaped ink well.

It is a further object of the present invention to provide a cassette for a wedge-shaped ink well having secure seating in the wedge-shaped ink well, which seating cannot be influenced by the stagnation pressure of the ink in the blade area.

It is yet another object of the present invention to provide a cassette for a wedge-shaped ink well which prevents contamination of the wedge-shaped ink well by ink.

The present invention makes it possible to secure the exact position of a cassette in a wedge-shaped ink well so that the cassette is not supported relative to the duct roller and cannot be influenced by external forces. Because the duct roller lies freely over the entire width of the wedge-shaped ink well, optimal and uniform inking of the roller is achieved. An effective seal of the cassette bottom and side walls relative to the wedge ink duct protects, to the greatest extent possible, against contamination by ink from the cassette to the wedge-shaped ink well.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
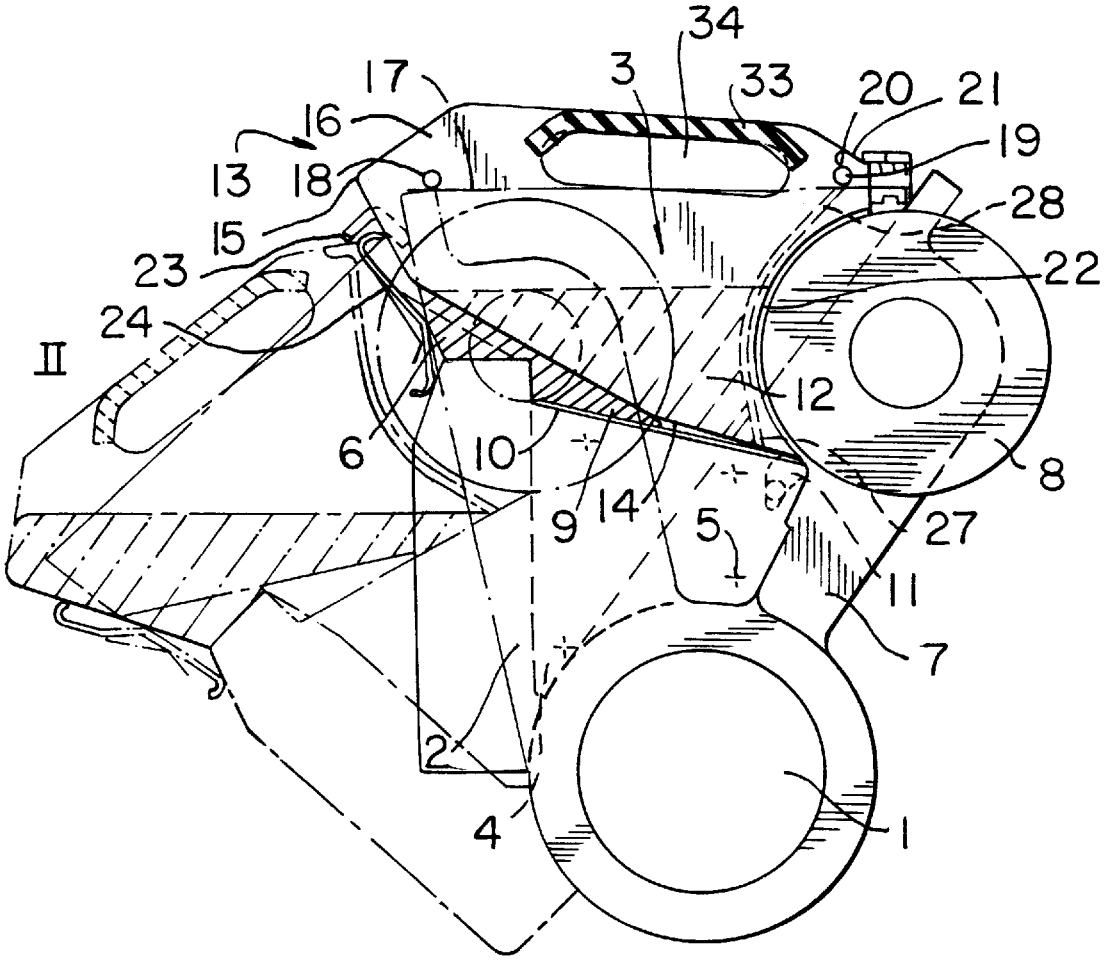
FIG. 1 shows a cassette according to the present invention in a wedge-shaped ink well that is pivotable (with the duct roller) between an operating position I and a cassette exchange position II.

Referring to FIG. 1, a base body 2 housing a wedge-shaped ink well 3 is pivotally connected to an axle 1. A front of the base body 2 faces a duct roller 8 which will be described in greater detail below. A rear of the base body 2 faces away from the duct roller 8. The axle 1 is fixedly connected to a frame of a printing machine (the frame and printing machine are not shown in the drawings). Side parts 4 of the wedge-shaped ink well 3 are attached to the base body 2 by screws 5. The side parts 4 are reinforced by a traverse 6 which is screwed onto the base body 2 at the rear of the base body 2.

In the operating position I, the side parts 4, which are provided with a curvature corresponding to the shape of the duct roller 8, rest in an ink-tight manner on the duct roller 8. Duct roller 8 is separately mounted on a holder 7. The holder 7 is pivotally mounted on the axle 1 independent of the base body 2. An ink blade 10 is attached to the base body 2 between the side parts 4 and in the area of the duct roller 8 by a clamping piece 9. The ink blade 10 is attached in a free-lying and elastically flexible fashion, allowing an adjustment that changes the width of the space between the ink blade 10 relative to the duct roller 8 by a cam lever 11, which supports the ink blade 10 from below the duct roller 8.

Figure 9:
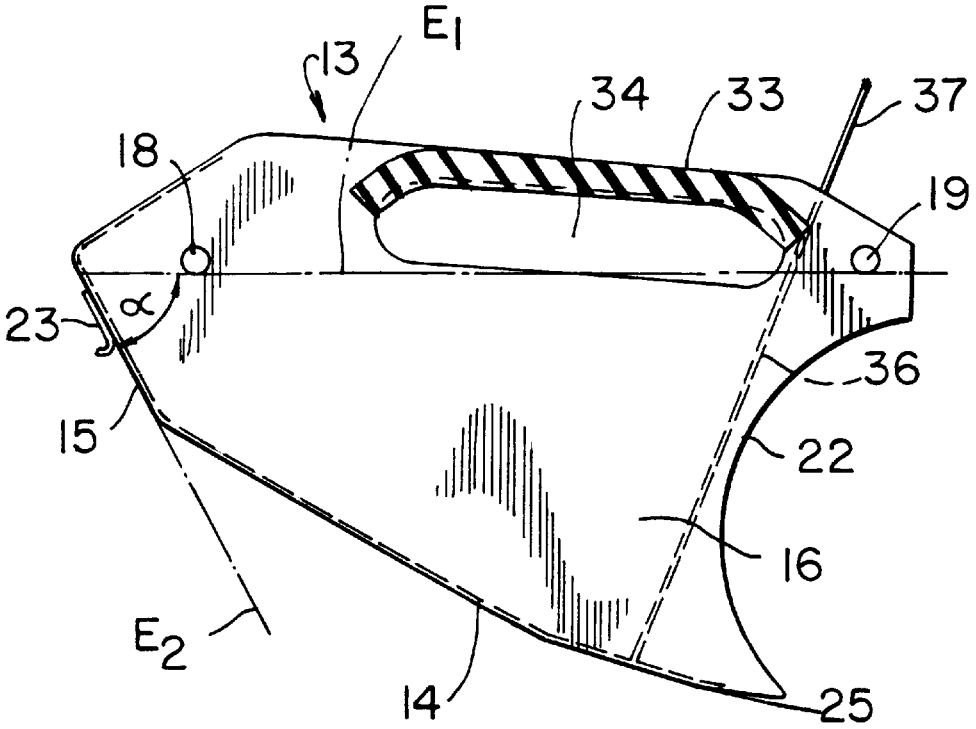
FIG. 9 is a side view of the cassette of the present invention.

Referring now also to FIG. 9, a cassette 13 holding ink 12 is removably mounted between the side parts 4 of the wedge-shaped ink well 3. The cassette 13 includes two side walls 16 connected by a bottom 14 and an angled back wall 15.

Figure 2:
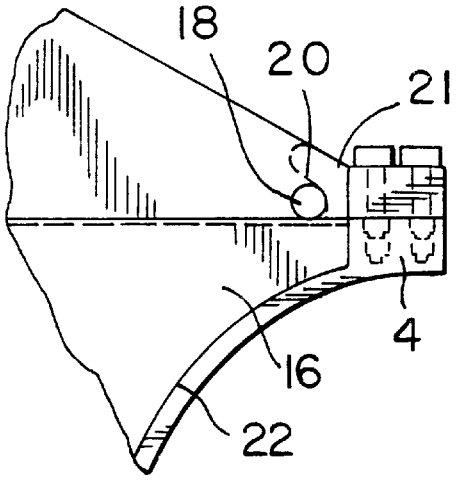
FIG. 2 shows an enlarged side view of a portion of the cassette which fixes the cassette in place near the duct roller via a bolt and an abutment on the side parts of the wedge-shaped ink well.

Referring now to FIGS. 1 and 2, the cassette 13, which projects above the side parts 4, is supported via a seating arranged externally on the side walls 16 of the cassette 13 along the respective supporting top surfaces 17 of the side parts 4. The seating comprises two supporting bolts 18, 19 arranged in offset fashion laterally projecting from side walls 16 and resting along the supporting top surface 17 of side parts 4. The bolt 19, which is closer to duct roller 8 than the bolt 18, engages a recess 20, located on a side of an abutment 21 facing away from the duct roller 8. Abutment 21 is attached to the supporting surface 17. The engagement of the bolt 19 and the recess 20 fixes the cassette 13 in position relative to the duct roller 8 and also prevents the cassette 13 from lifting off of the supporting top surface 17. Front surfaces 22 of the side wall 16 have a curvature corresponding to the contour of the duct roller 8 and rest upon the open longitudinal side of the cassette 13. The front surfaces 22 are located at a distance from the duct roller 8, such that the duct roller 8 is inked completely over its entire width between the side parts 4 of the wedge-shaped ink well 3.

Figure 3:
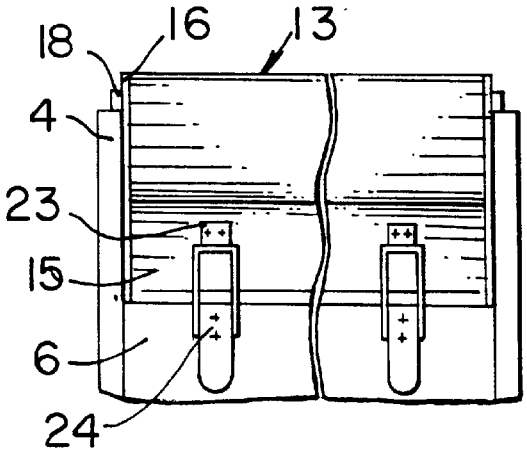
FIG. 3 shows fasteners with clasps arranged on the back wall of the cassette and on the wedge-shaped ink well.

Referring now to FIGS. 1 and 3, two clasps 23 are attached to the back wall 15 of the cassette 13 in an offset manner in the longitudinal direction. Each clasp 23 is connectable to a fastener 24 which is attached to the aligned longitudinal side of the supporting traverse 6. Referring now also to FIG. 9, when the fastener 24 is stressed, due to the connection of the clasp 23 and fastener 24 on a plane E2, which is located at an acute angle $\alpha$ relative to the supporting plane E1 of the bolts 18, 19, the forward supporting bolt 19 is pressed into the recess 20 of the abutment 21, and the rear supporting bolt 18 is urged toward the supporting top surface 17 of the side part 4. In this manner, the cassette 13 is held in a fixed position relative to the wedge-shaped ink well 3 and the duct roller 8.

Figure 7:
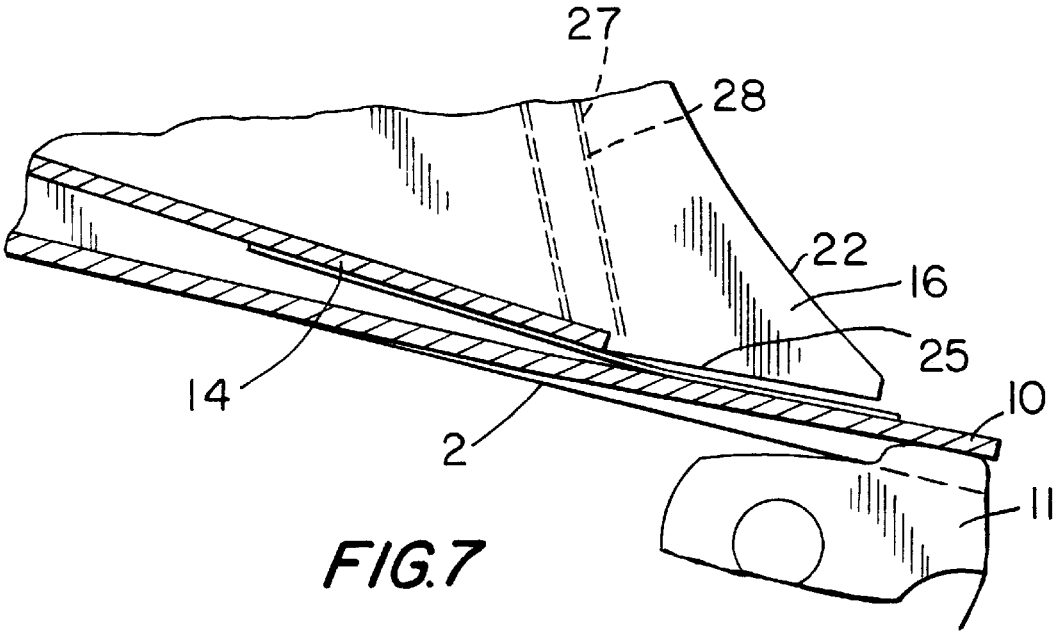
FIG. 7 shows a seal of the cassette bottom relative to the ink blade of the wedge-shaped ink well by an elastically deformable strip.

Referring now to FIGS. 1 and 7, an elastically deformable strip 25 is attached along the bottom 14 of the cassette 13 to seal the cassette 13, thereby preventing ink 12 from escaping through the open longitudinal side of the cassette 13 into the wedge-shaped ink well 3. Without the deformable strip 25, the bottom 14 of cassette 13 stands free of the ink blade 10 creating a gap through which ink 12 could escape. The strip 25 is supported on the ink blade 10 set back relative to the front edge of the ink blade 10 and parallel to the duct roller 8.

Figure 8:
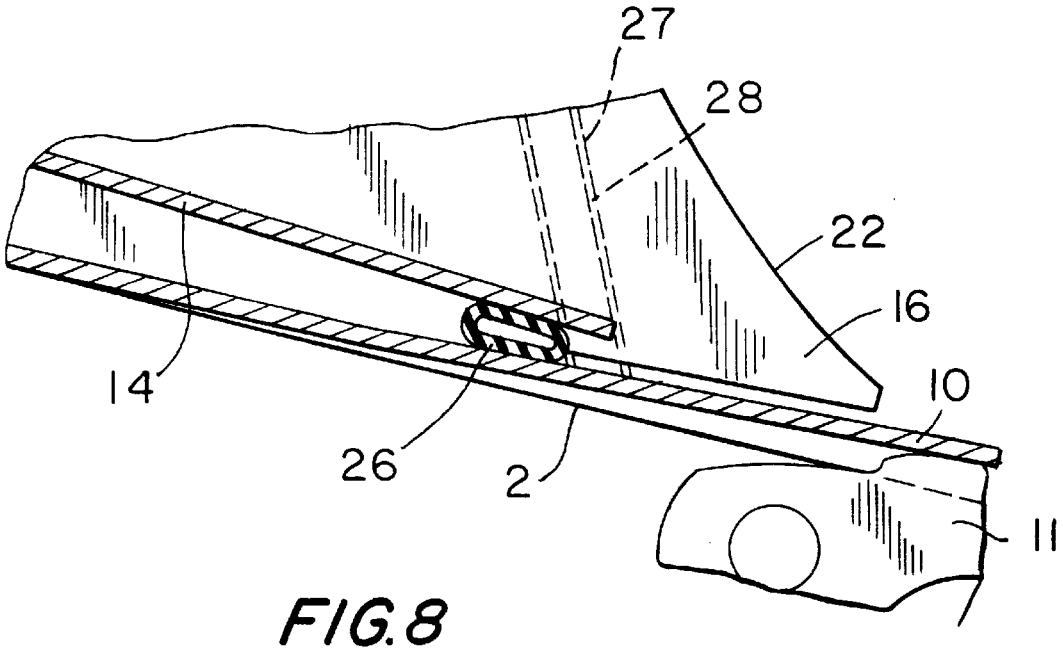
FIG. 8 shows a variant of the seal of FIG. 7 with an elastically deformable sealing profile.

Referring to FIG. 8, the strip 25 can also be an elastically deformable sealing profile 26 arranged in the longitudinal direction in the area of the front edge of the bottom 14 between the bottom 14 and the ink blade 10.

Figure 4:
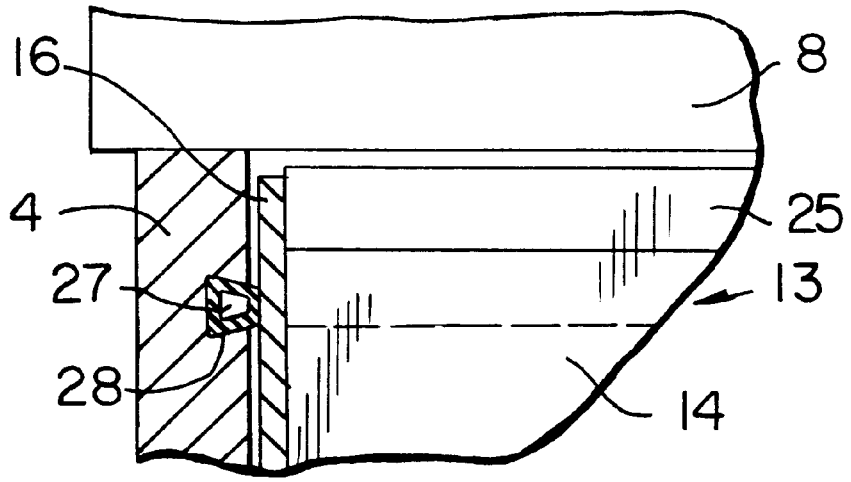
FIG. 4 shows a lateral seal, in the form of sealing profiles, between the cassette and the wedge-shaped ink duct.
Figure 5:
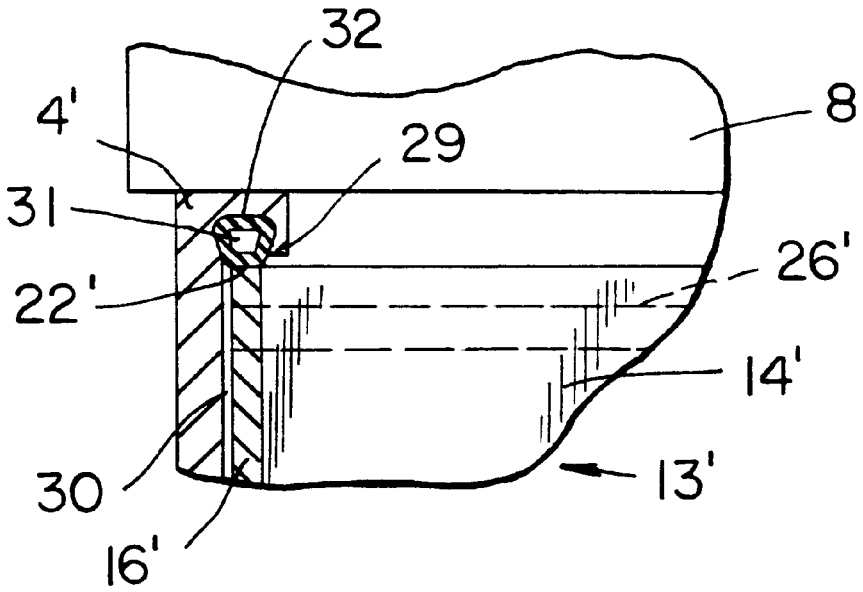
FIG. 5 shows a variant of the lateral seal of FIG. 4, with a cassette insertable into lateral recesses of the wedge-shaped ink well.
Figure 6:
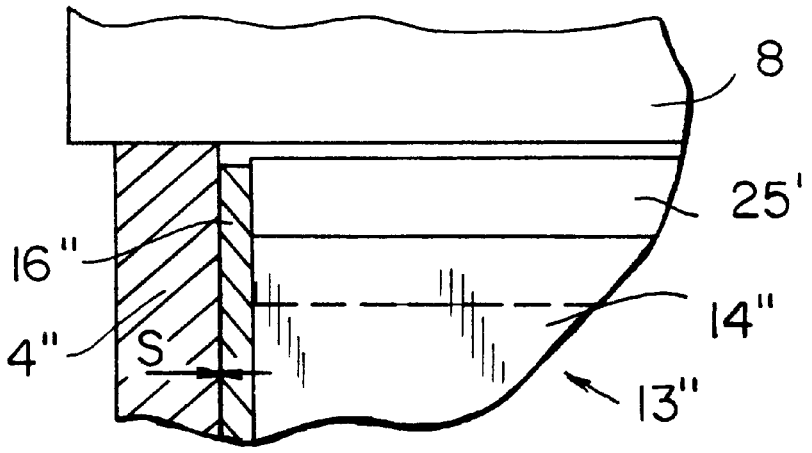
FIG. 6 shows another variant of the lateral seal of FIG. 4, in the form of a space seal, between the cassette and the wedge-shaped ink well.

FIGS. 4 through 6 show variations of a lateral seal of the cassette 13 relative to the side parts 4 of the wedge-shaped ink well 3. FIGS. 1 and 4 show an elastically deformable and laterally projecting sealing profile 28 inserted in a groove 27 in the side part 4. The groove 27 starts in the area of the longitudinal side seal on the bottom 14 and extends to the supporting surface 17 of side part 4. The sealing profile 28 is arranged to rest against the side wall 16 of the cassette 13.

FIG. 5 shows another embodiment of the lateral seal of FIG. 4 in which each side wall 16' of the cassette 13' is inserted in a recess 30 of the side part 4'. The recess 30 terminates with a closing surface 29 in front of the duct roller 8. An elastically deformable sealing profile 32 arranged in a groove 31 of the closing surface 29 rests on the front surface 22' of the cassette 13' thereby preventing the ink 12 from escaping around the side walls 16' of the cassette 13' and into the wedge-shaped ink well 3.

FIG. 6 shows another embodiment of the lateral seal of FIG. 4 in which the outer surface of the side wall 16" and the inner surface of the side part 4" are designed as a space seal wherein the width of a space S is 0.05 to 0.1 mm.

Referring now to FIGS. 1 and 9, a handling recess 34 is arranged in an area of the side wall 16 of the cassette 13 that extends over the side part 4. The upper holding area of handling recess is covered with a plastic or rubber profile 33. The handling recess 34 is positioned relative to the center of gravity of the cassette 13 with ink 12, such that the cassette 13, when handled separately from the wedge-shaped ink well 3, automatically inclines in the direction of its back wall 15, thereby preventing an outflow of ink 12 on the open longitudinal side. The position in which cassette 13 is inclined is analogous to the cassette changing position II in FIG. 1.

The wedge-shaped ink well can be pivoted to a cassette changing position II shown in FIG. 1, together with the duct roller 8, to permit the cassette 13 to be inserted into or removed from the wedge-shaped ink well 3 when in the inclined position. In this position, the ink 12 flows away from the open longitudinal side of the cassette 13, even at maximum ink level.

Figure 10:
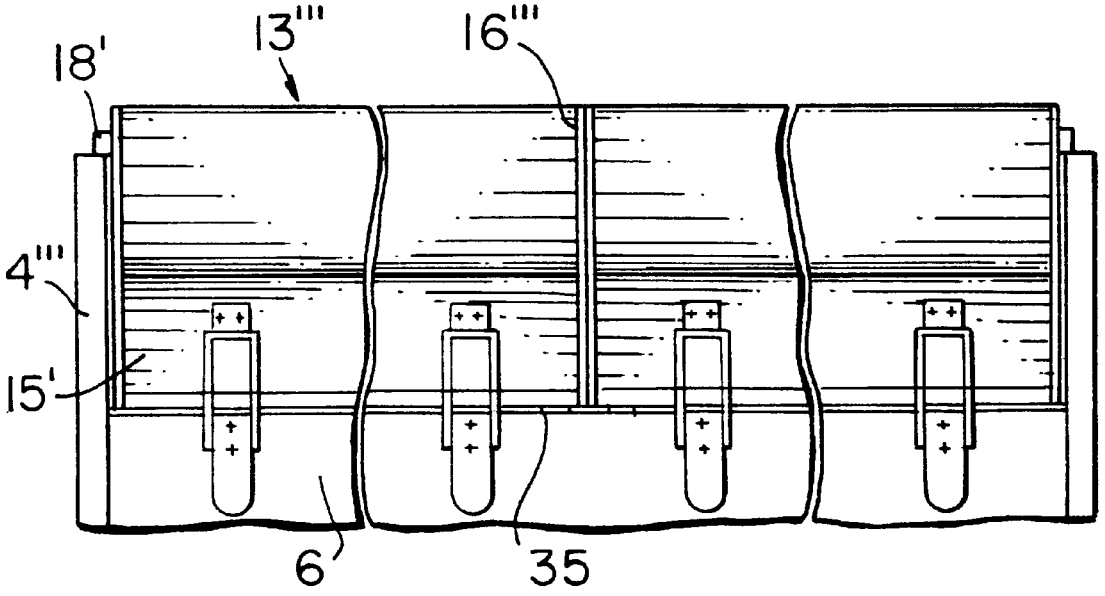
FIG. 10 shows an embodiment of the present invention with two cassettes arranged next to each other in a wedge-shaped ink well.

Referring now to FIG. 10, two cassettes 13"' are arranged next to each other between the side parts 4"' of an overbroad wedge-shaped ink well. The two cassettes 13"' are easier to handle than one large cassette which would be heavy and cumbersome to handle. In the area of their back wall 15' and of their side wall 16"', which is arranged in the center of in the wedge ink duct, the cassettes 13"' rest, on the bottom side, against the wedge-shaped ink well via a supporting element 35.

For wedge-shaped ink wells that can be tilted (not including the duct roller) for insertion or removal of the cassette 13, the cassette 13 optionally includes a blocking device such as a blocking gate 37 which is guided into position through guide channels 36 on the side walls 16, as in FIG. 9 to hold back the ink 12.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature.

It is the intention, therefore, to be limited only as indicated by the scope of the claims appended hereto.

We claim:

1. In a printing machine, an operatively rotatable duct roller having a curved surface, a substantially wedge-shaped ink well laterally bounded by a pair of opposed sidewalls each having a front edge curved to correspond to the curved surface of the duct roller and operatively disposed in ink-tight sealing relation with the duct roller surface to prevent passage of ink between the sidewall front edge and the duct roller curved surface, and a cassette for retaining a supply of ink for application to the duct roller, said cassette being operatively disposed for use in said ink well and being selectively removable from and reinsertable in the ink well, said cassette comprising a pair of opposed sidewalls each having a front edge operatively disposed in confrontingly-opposed relation to the duct roller surface and a bottom portion having a front edge operatively disposed in confrontingly opposed relation to the duct roller surface, each of said front edges of the cassette sidewalls and bottom portion being spaced, in the operative position of the cassette, from the duct roller surface by an amount sufficient to permit passage of ink between said each front edge and the duct roller surface so as to permit complete inking of the duct roller between the ink well sidewalls, each of said cassette sidewalls and a respective one of said ink well sidewalls being disposed in confrontingly opposed relation and together comprising means for forming an ink-tight seal between said each cassette sidewall and said respective ink well sidewall for preventing passage of ink therebetween.

2. In a printing machine in accordance with claim 1, wherein said cassette sidewalls project above the sidewalls of the wedge-shaped ink well, and each of said cassette sidewalls includes a seating resting on the respective sidewall of the wedge-shaped ink well;

said seating, in an area proximate the duct roller, being fixedly positioned relative to the duct roller via an abutment on the wedge-shaped ink well; and said cassette further comprising a back wall and means for attaching said back wall to the wedge-shaped ink well, said means for attaching urging said seating against the abutment and preventing said cassette sidewalls from lifting off the sidewalls of the wedge-shaped ink well.

3. In a printing machine in accordance with claim 2, wherein said seating comprise s two supporting bolts arranged in offset fashion along a supporting surface of each sidewall of the wedge-shaped ink well, fixedly connected to and laterally projecting from each said cassette sidewall;

one of said two supporting bolts positioned closest to the duct roller engaging, in a positive-locking manner, a recess defined on a side of the abutment facing away from the duct roller.

4. In a printing machine in accordance with claim 3, wherein said means for attaching further comprises a clasp and a fastener suspendable in said clasp, installed in pairs in alternating fashion on said back wall and on the wedge-shaped ink well in a first plane arranged at an acute angle ($\alpha$) relative to a second plane of said two supporting bolts.

5. In a printing machine in accordance with claim 1, wherein said means forming an ink-tight seal comprises side sealing elements closely proximate said front edges of said cassette sidewalls, said side sealing elements being positioned between each of said cassette sidewalls and the respective confrontingly-opposed sidewall of the wedge-shaped ink well, said side sealing elements extending from a bottom portion of said cassette to at least a maximum ink fill level of said cassette.

6. In a printing machine in accordance with claim 5, wherein said side sealing elements comprise an elastically deformable sealing profile projecting into a groove defined in the sidewalls of the wedge-shaped ink well and pressed against the sidewalls of said cassette to form said ink-tight seal between the cassette sidewalls and the confrontingly-opposed ink well sidewalls.

7. In a printing machine in accordance with claim 5, wherein each of the sidewalls of the wedge-shaped ink well defines a recess with a closing surface in an area where the each sidewall of the wedge-shaped ink well abuts the duct roller, and said side sealing elements comprise a sealing profile positioned between said front edge of each of said cassette sidewalls and the closing surface of the recess.

8. In a printing machine in accordance with claim 1, wherein outer surfaces of said cassette sidewalls and confrontingly opposed inner surfaces of the sidewalls of the wedge-shaped ink well comprise a space seal formed by spacing the cassette sidewall outer surfaces from the ink well sidewall inner surfaces by a distance preventing passage of ink therebetween.

9. In a printing machine in accordance with claim 8, wherein said spacing between the cassette sidewall outer surfaces and the inner surfaces of the wedge-shaped ink well is 0.05 to 0.1 mm.

10. In a printing machine in accordance with claim 1 and further comprising an ink ductor blade extending from the ink well into contact with the duct roller surface, wherein said cassette further comprises a bottom, the cassette further comprising a sealing element comprising a sealing element comprising a strip fixedly connected to said bottom of said cassette and extending toward and parallel to the duct roller, said strip resting in an elastically deformable manner against the ink ductor blade such that a seal is formed between said cassette and the ink ductor blade.

11. In a printing machine in accordance with claim 1 and further comprising an ink ductor blade extending from the ink well into contact with the duct roller surface, wherein said cassette further comprises a bottom and defines a front of the cassette in opposed relation to the duct roller, the cassette further comprising a sealing element comprising an elastically deformable sealing profile compressed between said bottom of said cassette and the ink ductor blade and extending parallel to said front of said cassette and forming a compound seal between said cassette and the ink ductor blade.

12. In a printing machine in accordance with claim 1, said cassette further comprising a handle connected to an upper portion of each of the cassette sidewalls and a bottom having a front confrontingly opposed to the duct roller, and said cassette having a center of gravity, wherein said handle element further comprises a handling recess on an upper part of said cassette sidewalls projecting over the sidewalls of the wedge-shaped ink well and disposed relative to said center of gravity when the cassette retains a supply of ink such that said cassette, when being inserted in and removed from said wedge-shaped ink well, automatically inclines toward the rear wall so as to prevent an unintended outflow of retained ink through said front of said bottom of said cassette.

13. In a printing machine in accordance with claim 12, wherein said handling recess further comprises a profile covering material comprising one of plastic and rubber on an upper holding area of said handling recess.

14. In a printing machine in accordance with claim 1, wherein said cassette further comprises first and second housings defining respective first and second ink-retaining portions so that said first and second housings are individually removable from and reinsertable in the ink well, said cassette further comprising a central wall in each of said first and second housings in opposed relation to a respective one of said cassette sidewalls so that each of the first and second ink retaining portions is laterally bounded by a central wall and a respective one of the cassette sidewalls, and said ink well further comprising a support for supporting the central walls of said first and second housings when said housings are operatively positioned in the ink well with the central walls of said first and second housings being disposed in confrontingly-opposed relation to locate said first and second housings in side-by-side relation.

* * * * *